US007174826B2

(12) United States Patent
Kerrigan et al.

(10) Patent No.: US 7,174,826 B2
(45) Date of Patent: Feb. 13, 2007

(54) HYDRAULIC CROWD CONTROL MECHANISM FOR A MINING SHOVEL

(75) Inventors: Timothy R. Kerrigan, New Berlin, WI (US); Carl D. Gilmore, South Milwaukee, WI (US); Matthew Brueck, New Berlin, WI (US); Jeanne M. Yaunke, Richmond, WI (US); Michael Haws, Racine, WI (US); Michael G. Onsager, Franklin, WI (US)

(73) Assignee: Bucyrus International, Inc., South Milwaukee, MI (US)

( * ) Notice: Subject to any disclaimer, the term of this patent is extended or adjusted under 35 U.S.C. 154(b) by 0 days.

(21) Appl. No.: 11/041,783

(22) Filed: Jan. 24, 2005

(65) Prior Publication Data

US 2005/0163603 A1 Jul. 28, 2005

Related U.S. Application Data

(60) Provisional application No. 60/539,619, filed on Jan. 28, 2004.

(51) Int. Cl.
*F15B 11/08* (2006.01)

(52) U.S. Cl. ..... 91/420; 91/421; 91/461

(58) Field of Classification Search ..... 91/420, 91/421, 461

See application file for complete search history.

(56) References Cited

U.S. PATENT DOCUMENTS 3,015,316 A * 1/1962 Thomas ..... 91/420
3,144,146 A * 8/1964 Strickland, Jr. ..... 414/690
3,425,574 A 2/1969 Willgrubs
3,586,184 A * 6/1971 Pesavento et al. ..... 414/685
3,690,483 A 9/1972 Kraschnewski
4,268,214 A 5/1981 Zeldman
5,829,252 A * 11/1998 Hirata et al. ..... 60/421
6,502,500 B2 * 1/2003 Yoshino ..... 91/446

* cited by examiner

*Primary Examiner*—Hoang Nguyen
(74) *Attorney, Agent, or Firm*—Quarles & Brady LLP

(57) ABSTRACT

A crowd control mechanism for a power shovel includes an extendible dipper handle having an extended position and a retracted position. A double acting hydraulic cylinder having a an extendible ram has one of the cylinder and the ram fixed to the dipper handle and the other of the cylinder and the ram is stationary relative to the dipper handle. At least one of the cylinder and the ram have at least one of a blind end port and a rod end port, and at least one of the cylinder and the ram have the other of the blind end port and the rod end port, wherein hydraulic fluid flowing into the cylinder through the blind end port urges the ram toward an extended position to extend the dipper handle, and hydraulic fluid flowing into the rod end port urges the ram toward a retracted position to retract the dipper handle. Hydraulic fluid flowing into and out of the cylinder is controlled by one or more pilot operated poppet valves. A spool valve is disposed in a pilot line controlling at least one of the pilot operated poppet valves, and the spool valve controls the flow of fluid into the pilot line to control the at least one pilot operated poppet valve as opposed to a spool valve directly controlling the flow of hydraulic fluid into and out of the cylinder.

18 Claims, 6 Drawing Sheets

106
154
104
102
118
168
124
172
122
58
70
62
72
52
54
60
50
68
56
64
66
100a
100b
100c
100d

HYDRAULIC CROWD CONTROL MECHANISM FOR A MINING SHOVEL

CROSS REFERENCES TO RELATED APPLICATIONS

This application claims the priority benefit of U.S. Provisional Patent Application No. 60/539,619 filed on Jan. 28, 2004.

STATEMENT REGARDING FEDERALLY SPONSORED RESEARCH

Not Applicable.

TECHNICAL FIELD

This invention relates to mining shovels, and more particularly to hydraulic crowd control mechanisms for a mining shovel.

DESCRIPTION OF THE BACKGROUND ART

A typical mining shovel includes a turntable mounted on a crawler truck, and supporting an A-frame and a cab. A boom extending from the turntable has an upper end supported by the A-frame. The boom pivotally supports a dipper handle which pivots in a vertical plane. A dipper fixed to a distal end of the dipper handle is raised and lowered by a hoist cable which extends over a sheave at the top of the boom and down to a padlock on the dipper. The hoist cable provides for the vertical, raising and lowering, movement of the dipper. A crowd mechanism extends and retracts the dipper handle to provide the horizontal component, or crowd, of the dipper's movement.

Many different crowd mechanisms have been developed over the years. Rack and pinion crowd mechanisms include a rack fixed to the dipper handle which engages a rotatably driven pinion, or gear, mounted in the boom. Rope crowd mechanisms include metal ropes that are wound and unwound from a crowd drum to extend and retract the dipper handle. Hydraulic crowd mechanisms, such as disclosed in U.S. Pat. No. 3,425,574, which utilizes a large double-acting hydraulic actuator are also known in the art. All of these mechanisms have advantages and disadvantages.

Hydraulic crowd mechanisms can use round tubular handles that are free to rotate while the rack and pinion mechanism must remain rotatably fixed. Moreover, hydraulic crowd mechanisms are not prone to broken rack teeth or ropes resulting from excessive force, such as in the gear and rack crowd mechanism or the rope crowd mechanism. Unfortunately, in the prior art, the volume of hydraulic fluid necessary to control the crowd of a mining shovel dipper handle prevents a quick response to operator inputs compared to the other crowd mechanisms because of the mass of the spools in control valves used to control the flow of the hydraulic fluid. Accordingly, a need exists for a hydraulic crowd mechanism which responds quickly to operator inputs compared to the prior art.

SUMMARY OF THE INVENTION

The present invention provides a hydraulic crowd control mechanism that responds quickly to operator inputs. In one embodiment, the crowd control mechanism includes an extendible dipper handle having an extended position and a retracted position. A double acting hydraulic cylinder having an extendible ram has one of the cylinder and the ram fixed to the dipper handle and the other of the cylinder and the ram is stationary relative to the dipper handle. At least one of the cylinder and the ram have at least one of a blind end port and a rod end port, and at least one of the cylinder and the ram have the other of the blind end port and the rod end port, wherein hydraulic fluid flowing into the cylinder through the blind end port urges the ram toward an extended position to extend the dipper handle, and hydraulic fluid flowing into the rod end port urges the ram toward a retracted position to retract the dipper handle. Hydraulic fluid flowing into and out of the cylinder is directly controlled by one or more pilot operated poppet valves. At least one of the pilot operated poppet valves is controlled by a spool valve disposed in the pilot line of the poppet valves to improve the response time to operator inputs over a spool valve directly controlling the flow of hydraulic fluid into and out of the cylinder.

A general objective of the present invention is to provide a crowd control mechanism of a power shovel that responds quickly to operator inputs. This objective is accomplished by controlling the flow of hydraulic fluid using poppet valves that are controlled by spool valves disposed in the pilot line of the poppet valves.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
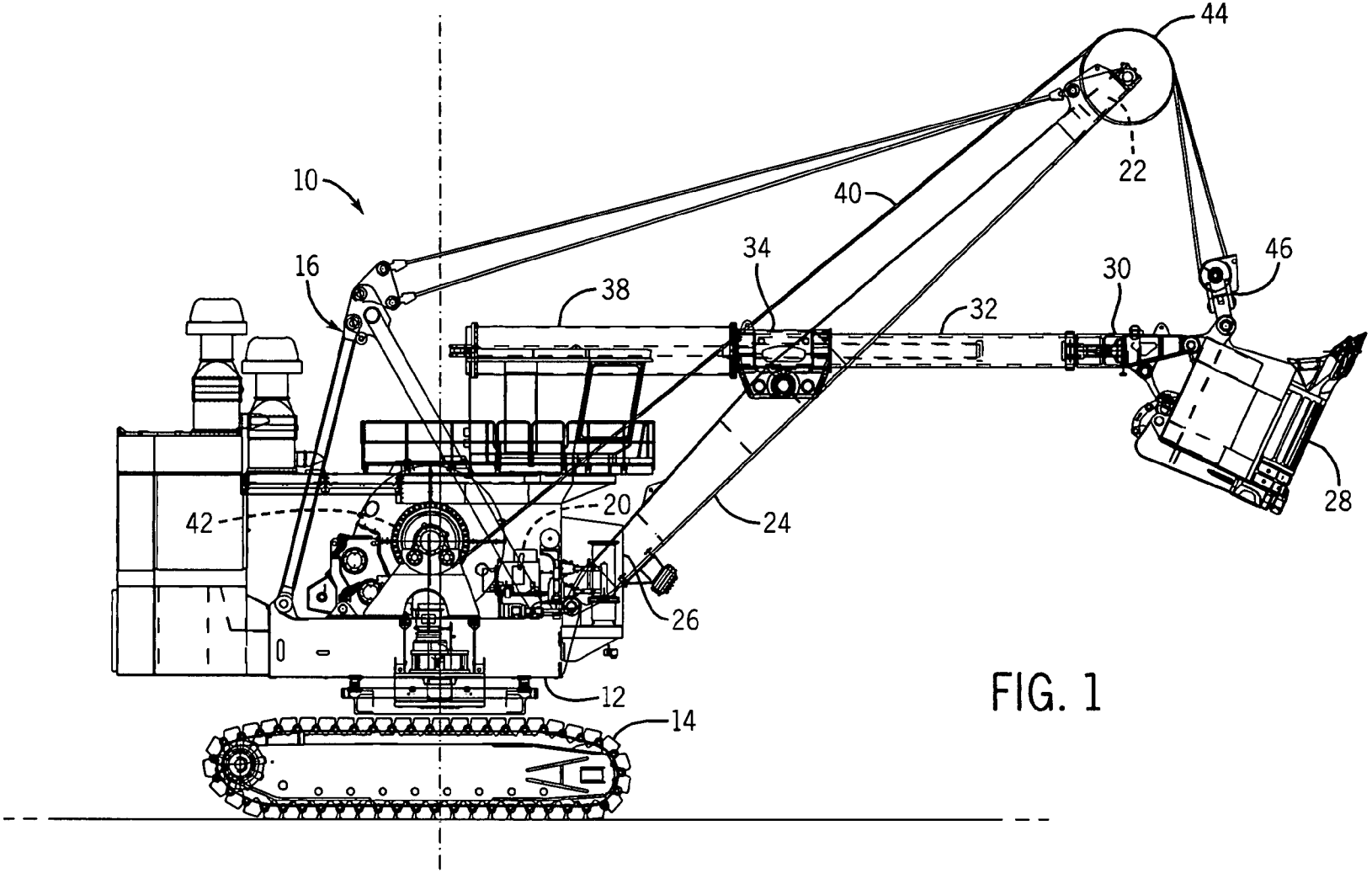
FIG. 1 is a side view elevation of a power shovel utilizing a crowd control mechanism incorporating the present invention.

Referring to FIGS. 1–5, a mining shovel 10 includes a turntable 12 mounted on a crawler truck 14, and supporting an A-frame 16 and a cab 18. The cab houses a power unit 20, control equipment, and operator. The control equipment includes an electrical control system that operates the mining shovel components in response to inputs from the operator and automatic devices, such as limit switches, pressure switches, and temperature switches, and the like. The operator can provide inputs from within the cab through manually operable devices, such as a joystick, lever, foot pedals, rocker switches, computer keyboard, touch pads, and the like.

The A-frame 16 supports a top end 22 of a boom 24, a bottom end 26 of the boom 24 being supported by the turntable 12. A dipper 28 is mounted on the front end 30 of a dipper handle 32 which is slidably supported in a saddle block 34 mounted in the boom 24. The saddle block includes a yoke 36 and a support frame 38 which projects rearwardly from the yoke 36 and encloses the back end of the dipper handle 32. The yoke 36 of the saddle block 34 is pivotally mounted in the boom 24, so as to pivot in a vertical plane. A hoist cable 40 extends upward from a powered hoist drum 42 on the turntable 12, over a sheave 44 at the top end 22 of the boom 24 and down to a padlock 46 on the dipper 28. The hoist cable 40 provides for the vertical, raising and lowering, movement of the dipper 28. A hydraulic crowd mechanism 48 enclosed in the piston rod support frame 38, provides the horizontal component, or crowd, of the dipper's movement.

The hydraulic crowd control mechanism 48 includes a double acting hydraulic actuator 50 having a cylinder 52 and an extendible ram 54. In the embodiment disclosed herein, the cylinder 52 is fixed relative to the saddle block 34, and the ram 54 is fixed relative to the dipper handle. As a result, extension of the ram 54 from a retracted position in the cylinder 52 toward an extended position urges the dipper handle 32 from a retracted position to an extended position. Conversely, retraction of the ram 54 into the cylinder 52 from the extended position toward the retracted position urges the dipper handle 32 from the extended position toward the retracted position. Of course, the cylinder 52 can be fixed relative to the dipper handle 32, and the ram 54 can be fixed relative to the saddle block 34 without departing from the scope of the invention.

Figure 2:
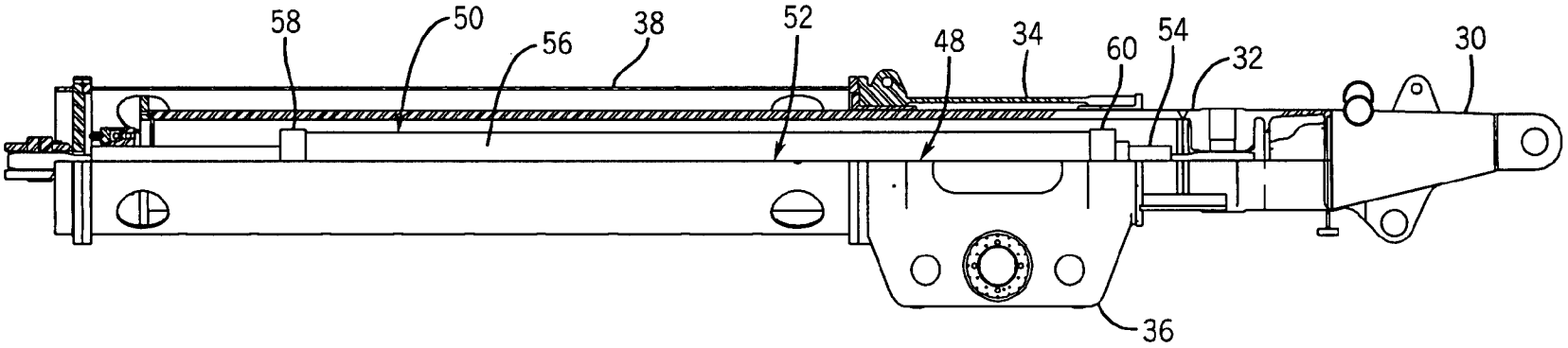
FIG. 2 is a side view elevation, partially in section, of the dipper handle and saddle block of the power shovel of FIG. 1.
Figure 3:
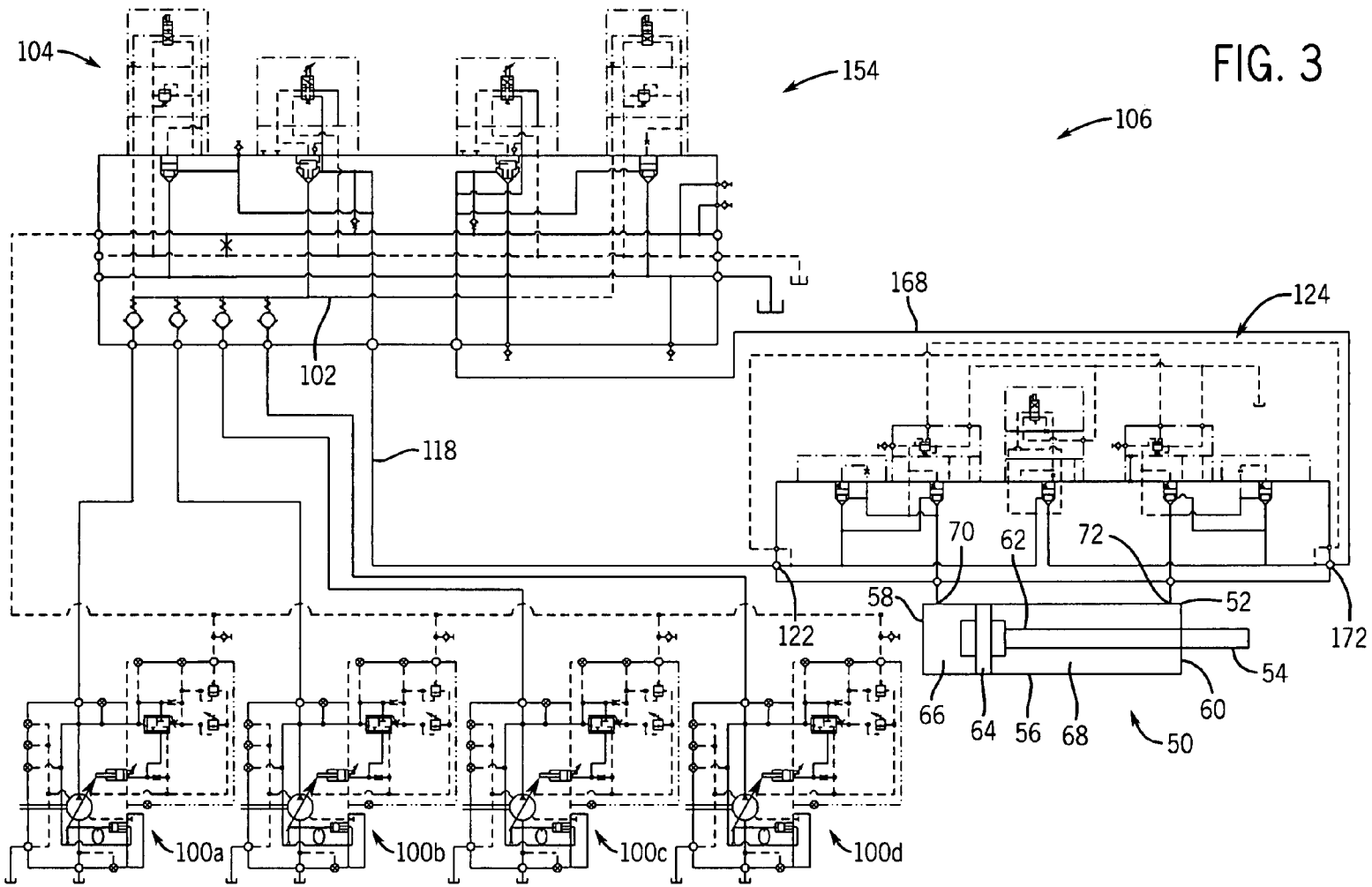
FIG. 3 is a schematic diagram of the power unit of the crowd control mechanism of FIG. 1.
Figure 5:
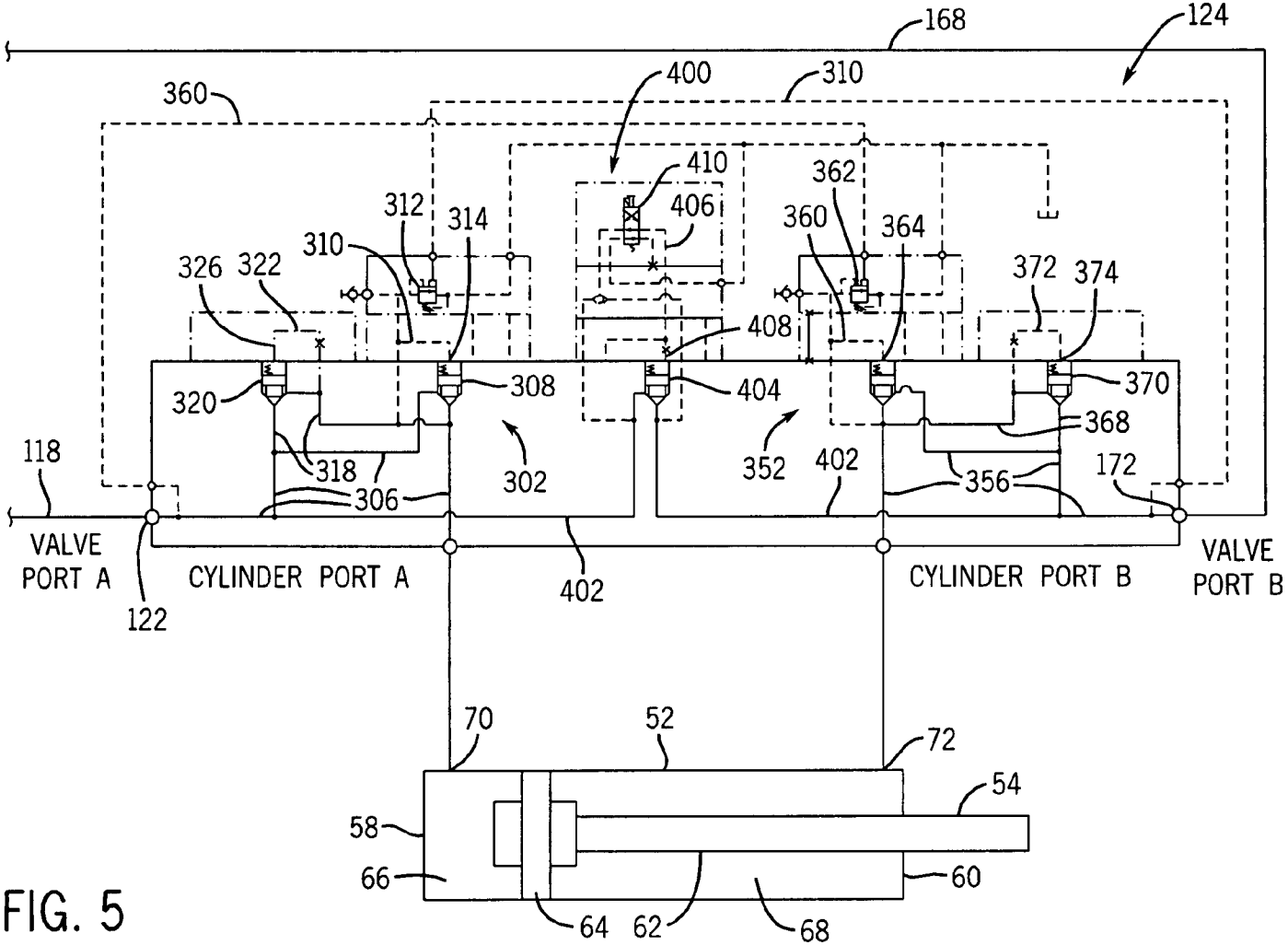
FIG. 5 is a schematic diagram of the counterbalance and regeneration circuits of FIG. 3.

The double-acting hydraulic actuator 50, shown in more detail in FIGS. 2, 3, and 5, includes the hollow cylinder 52 having a cylinder wall 56, a blind end 58, and a rod end 60 which defines a fluid chamber in the cylinder 52. An inner end 62 of the ram 54 extends into the fluid chamber through the rod end 60 of the cylinder 52. A piston 64 fixed to the inner end 62 of the ram 54 engages the cylinder wall 56 of the cylinder 52 and divides the fluid chamber into an extension chamber 66 and a retraction chamber 68. A blind end port 70 in fluid communication with the extension chamber 66 through the cylinder wall 56 supplies hydraulic fluid to the extension chamber 66 to expand the extension chamber 66 and urge the piston 64 towards the rod end 60 of the cylinder 52 and move the ram 54 toward the extended position. A rod end port 72 in fluid communication with the retraction chamber 68 through the cylinder wall 56 supplies hydraulic fluid to the retraction chamber 68 to expand the retraction chamber 68 and urge the piston 64 towards the blind end 58 of the cylinder 52 and move the ram 54 toward the retracted position. In the embodiment disclosed herein, hydraulic fluid in the retraction chamber 68 is forced out of the retraction chamber 68 through the rod end port 72 when the piston 64 is urged toward the rod end 60. Likewise, hydraulic fluid in the extension chamber 66 is forced out of the extension chamber 66 through the blind end port 70 when the piston 64 is urged toward the blind end 58. Of course, separate exhaust ports can be provided without departing from the scope of the invention.

Hydraulic fluid is supplied to the blind end and rod end ports 70, 72 of the actuator 50 at a rate of approximately 500 gpm at a pressure of approximately 3200 psi by hydraulic power unit 20 that has a fast response rate to commands from the operator. Although a power unit 20 that can supply hydraulic fluid at a rate of 500 gpm at any pressure is preferred, the present invention provides advantages at lower flow rates, such as 100 gpm, and most preferably at flow rates above 300 gpm. The advantages of the present invention diminish as the flow rate decreases because spool valves can react relatively quickly to operator inputs at flow rates below 100 gpm.

As shown in FIG. 3, the hydraulic power unit 20 includes four positive displacement pumps 100*a*, 100*b*, 100*c*, 100*d* that supply pressurized hydraulic fluid to a hydraulic supply line 102 forming part of a hydraulic circuit 106 having an extend hydraulic circuit 104 and a retract hydraulic circuit 154. The extend hydraulic circuit 104 supplies the pressurized hydraulic fluid from the hydraulic supply line 102 to the blind end port 70 of the actuator 50 through a counterbalance hydraulic circuit 124 to extend the dipper handle 32. The retract hydraulic circuit 154 supplies the pressurized hydraulic fluid from the hydraulic supply line 102 to the rod end port 72 to retract the dipper handle 32 through the counterbalance hydraulic circuit 124. The counterbalance hydraulic circuit 124 balances the flow of hydraulic fluid into and out of the actuator 50.

Figure 4:
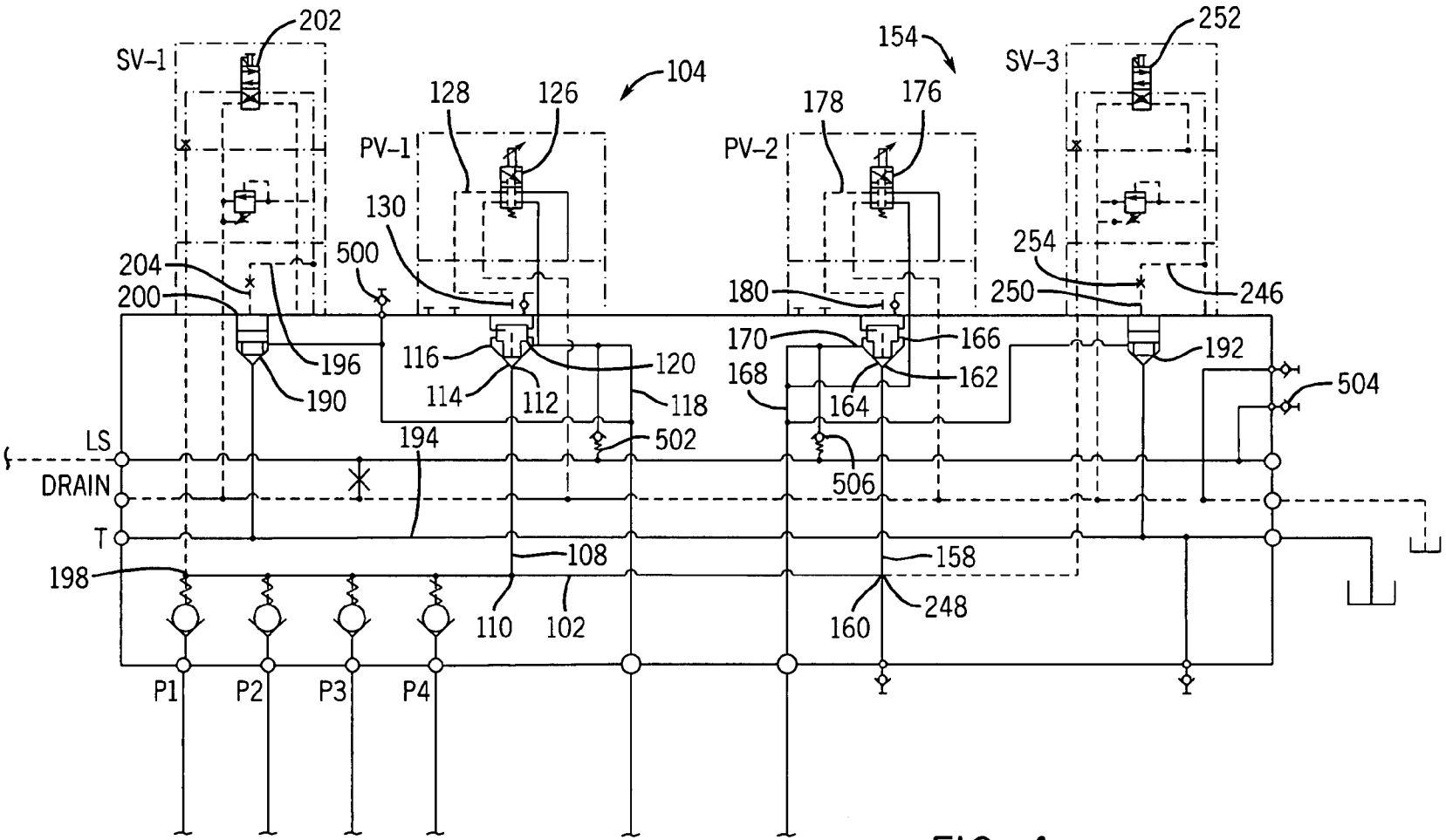
FIG. 4 is a schematic diagram of the extend and retract hydraulic circuits of FIG. 3.

Referring to FIGS. 3–5, the extend hydraulic circuit 104 includes an input extend hydraulic line 108 having one end 110 connected to the supply line 102 and an opposite end 112 connected to an input port 114 of a pilot operated proportional extend poppet valve 116. An output extend hydraulic line 118 connects an output port 120 of the extend poppet valve 116 to an extend input port 122 of a counterbalance hydraulic circuit 124 that supplies the hydraulic fluid to the blind end port 70 of the actuator 50. The extend poppet valve 116 is controlled by a normally closed proportional control extend spool valve 126 disposed in an extend pilot line 128 controlling the extend poppet valve 116. The extend pilot line 128 is connected to a pilot input 130 of the extend poppet valve 116 and the output extend hydraulic line 118.

The proportional control extend spool valve 126 controls the flow of hydraulic fluid through the extend pilot line 128 to control the flow of fluid through the extend poppet valve 116. The proportional control extend spool valve 126 is preferably a two position solenoid valve which controls the flow of hydraulic fluid through the extend pilot line 128 by selectively moving between two positions in response to inputs from the operator. In a first position, the proportional control extend spool valve 126 fluidly connects the pilot input 130 of the extend poppet valve 116 to the output extend hydraulic line 118, such that the pressure in the output extend hydraulic line 118 maintains the extend poppet valve 116 in the open position. In a second position, the proportional control extend spool valve 126 fluidly disconnects the pilot input 130 of the extend poppet valve 116 from the output extend hydraulic line 118, such that there is insufficient pressure in the pilot input 130 of the extend poppet valve 116 to maintain the extend poppet valve 116 in the open position.

Advantageously, controlling the flow of hydraulic fluid necessary to move the dipper handle 32 using the poppet valve 116 in combination with the spool valve 126 provides a response to control inputs from the operator that is quicker than would be obtained by controlling the flow of hydraulic fluid necessary to move the dipper handle 32 using a spool valve alone. In particular, a spool valve of sufficient size to directly control the flow of hydraulic fluid necessary to move the dipper handle would require a spool having a large mass that decreases response time to operator inputs below acceptable levels.

The retract hydraulic circuit 154 is substantially identical to the extend hydraulic circuit 104 with the exception that the hydraulic fluid flowing through the retract hydraulic circuit 154 is ultimately fed into the rod end port 72 of the double-acting actuator 50. In particular, the retract hydraulic circuit 154 includes an input retract hydraulic line 158 having one end 160 connected to the supply line 102 and an opposite end 162 connected to an input port 164 of a pilot operated proportional retract poppet valve 166. An output retract hydraulic line 168 connects an output port 170 of the retract poppet valve 166 to a retract input port 172 of the counterbalance hydraulic circuit 124 that supplies the hydraulic fluid to the rod end port 72 of the actuator 50. The retract poppet valve 166 is controlled by a normally closed proportional control retract spool valve 176 disposed in a retract pilot line 178 controlling the retract poppet valve 166. The retract pilot line 178 is connected to a pilot input 180 of the retract poppet valve 166 and the output retract hydraulic line 168.

The proportional control retract spool valve 176 controls the flow of hydraulic fluid through the retract pilot line 178 to control the flow of fluid through the retract poppet valve 166. The proportional control retract spool valve 176 is preferably a two position solenoid valve which controls the flow of hydraulic fluid through the retract pilot line 178 by selectively moving between two positions in response to inputs from the operator. In a first position, the proportional control retract spool valve 176 fluidly connects the pilot input 180 of the retract poppet valve 166 to the output retract hydraulic line 168, such that the pressure in the output retract hydraulic line 168 maintains the retract poppet valve 166 in the open position. In a second position, the proportional control retract spool valve 176 fluidly disconnects the pilot input 180 of the retract poppet valve 166 from the output retract hydraulic line 168, such that there is insufficient pressure in the pilot input 180 of the retract poppet valve 166 to maintain the retract poppet valve 166 in the open position.

Extend and retract work port relief poppet valves 190, 192 are disposed in a short circuit hydraulic line 194 that connects the output hydraulic lines 118, 168 of the extend and retract hydraulic circuits 104, 154. In the event of pressure spikes while the dipper handle 32 is being driven by the hydraulic power unit 20 toward either the extend or retract positions, the work port relief valves 190, 192 relieves the pressure in the hydraulic power unit 20 by short circuiting the extend and retract hydraulic circuits 104, 154. The work port relief poppet valves 190, 192 are disposed in the short circuit hydraulic line 194 that connects the output lines 118, 168 of the extend hydraulic circuit and the retract hydraulic circuit 104, 154 to bypass the extend and retract poppet valves 116, 166 of both circuits 104, 154 when the work port relief poppet valves 190, 192 are open. Advantageously, the use of the lower mass poppet valves 190, 192, compared to a spool valve controlling the same hydraulic fluid flow will result in a fast response to any pressure spikes.

The normally open extend work port relief poppet valve 190 in the short circuit hydraulic line 194 is controlled by an extend work port relief pilot line 196 having one end 198 connected to the hydraulic supply line 102 and an opposite end 204 connected to a pilot line input 200 of the extend work port relief poppet valve 190. An extend work port relief two-position spool control valve 202 disposed in the extend work port relief pilot line 196 has a first position that fluidly connects the hydraulic supply line 102 and the pilot line input 200 of the extend work port relief poppet valve 190 and a second position that disconnects the hydraulic supply line 102 from the pilot line input 200 of the extend work port relief poppet valve 190. When the extend work port relief two-position spool control valve 202 is in the first position, the extend work relief poppet valve 190 can close in response to the pressure in the supply line 102, and when the extend work port relief two-position spool control valve 202 is in the second position, the extend work port relief poppet valve 190 remains in the open position regardless of the pressure in the supply line 102.

The retract work port relief poppet valve 192 in the short circuit hydraulic line 194 is controlled by a retract work port relief pilot line 246 having one end 248 connected to the hydraulic supply line 102 and an opposite end 254 connected to the pilot line input 250 of the retract work port relief poppet valve 192. A retract work port relief two-position spool control valve 252 disposed in the retract work port relief pilot line 246 has a first position that fluidly connects the hydraulic supply line 102 and the pilot line input 250 of the retract work port relief poppet valve 192 and a second position that disconnects the hydraulic supply line 102 from the pilot line input 250 of the retract work port relief poppet valve 192. When the retract work port relief two-position spool control valve 252 is in the first position, the retract work relief poppet valve 192 can close in response to the pressure in the supply line 102, and when the retract work port relief two-position spool control valve 252 is in the second position, the retract work port relief poppet valve 192 remains in the open position regardless of the pressure in the supply line 102.

The counterbalance hydraulic circuit 124 is preferably mounted adjacent the actuator 50 and hard piped to the blind end and rod end ports 70, 72, and includes a counterbalance extend hydraulic circuit 302 and a counterbalance retract hydraulic circuit 352. Advantageously, the counterbalance hydraulic circuit 124 provides a fail safe hydraulic lock at the actuator 50 to prevent the dipper handle 32 from "running away" in the event of a hydraulic line failure, such as a burst hydraulic hose. Additionally, the counterbalance hydraulic circuit 124 provides a pressure relief feature which will limit "front-end induced" hydraulic pressure spikes in the actuator 50 when the actuator 50 is locked by the counterbalance hydraulic circuit 124, thus limiting the magnitude of shock loads on the dipper 28 and dipper handle 32.

The counterbalance extend hydraulic circuit 302 includes a counterbalance extend hydraulic line 306 that fluidly connects the extend input port 122 to the blind end port 70 of the actuator 50. A counterbalance extend proportional poppet valve 308 of the counterbalance hydraulic circuit 124 disposed in the counterbalance extend hydraulic line 306 controls the flow of hydraulic fluid through the counterbalance extend hydraulic line 306 into the blind end port 70. The counterbalance extend proportional poppet valve 308 is controlled by a counterbalance extend pilot line 310 having one end connected to a counterbalance extend poppet valve pilot input 314 and the other end connected to a counterbalance retract hydraulic line 356 connecting the retract input port 172 and rod end port 72.

Flow through the counterbalance extend pilot line 310 is controlled by an extend counterbalance cartridge that controls the counterbalance extend proportional poppet valve 308 in response to a pressure difference between the counterbalance extend and retract hydraulic lines 306, 356 connected to the blind end and rod end ports 70, 72. In particular, when extending the dipper handle 32, if the hydraulic fluid pressure in the counterbalance extend hydraulic line 306 is less than the hydraulic fluid pressure in the counterbalance retract hydraulic line 356, the counterbalance cartridge 312 decreases the flow of hydraulic fluid through the counterbalance extend proportional poppet valve 308 to decrease the flow of hydraulic fluid into the extension chamber 66 of the cylinder 52 until the pressure difference falls within an acceptable range.

An extend bypass hydraulic line 318 bypasses the counterbalance extend poppet valve 308 in the counterbalance extend hydraulic circuit 302 to provide a flow path around the counterbalance extend poppet valve 308 to accommodate hydraulic pressure spikes that occur when the actuator 50 is locked by the counterbalance hydraulic circuit 124. Hydraulic fluid flow through the extend bypass hydraulic line 318 is controlled by an extend relief poppet valve 320 disposed in the extend bypass hydraulic line 318. An extend relief pilot line 322 having one end connected to a pilot input 326 of the extend relief poppet valve 320 and an opposite end connected to the extend bypass hydraulic line 318 between the extend relief poppet valve 320 and blind end port 70 controls the extend relief poppet valve 320. The normally closed extend relief poppet valve 320 opens when the pressure at the extend input port 122 is greater than the pressure in the extend relief pilot line 322 to relieve pressure spikes upstream of the counterbalance hydraulic circuit 124.

The counterbalance retract hydraulic circuit 352 is substantially identical to the counterbalance extend hydraulic circuit 302 with the exception that the hydraulic fluid flowing through the counterbalance retract hydraulic circuit 352 is fed into the rod end port 72 of the actuator 50. In particular, the counterbalance retract hydraulic circuit 352 includes the counterbalance retract hydraulic line 356 that connects the retract input port 172 of the counterbalance hydraulic circuit 124 to the rod end port 72 of the actuator 50. A counterbalance retract poppet valve 358 disposed in the counterbalance retract hydraulic line 356 controls the flow of hydraulic fluid through the counterbalance retract hydraulic line 356 into the rod end port 72. The counterbalance retract poppet valve 358 is controlled by a counterbalance retract pilot line 360 having one end connected to a counterbalance retract poppet valve pilot input 364 and the other end connected to the counterbalance extend hydraulic line 306 connecting the extend input port 122 and blind end port 70 in the counterbalance extend hydraulic circuit 302.

Flow through the counterbalance retract pilot line 360 is controlled by a counterbalance retract cartridge 362 that closes the counterbalance retract poppet valve 358 in the event of a pressure difference between the hydraulic lines 306, 356 connected to the blind end and rod end ports 70, 72 exceeds a predetermined value. In particular, when retracting the dipper handle 32, if the hydraulic fluid pressure in the counterbalance retract hydraulic line 356 is lesser than the hydraulic fluid pressure in the counterbalance extend hydraulic line 306, the counterbalance retract cartridge 362 decreases the flow of hydraulic fluid through the proportional counterbalance retract poppet valve 358 to decrease the flow of hydraulic fluid into the retraction chamber 68 of the cylinder 52 until the pressure difference falls within an acceptable range.

A retract bypass hydraulic line 368 bypasses the counterbalance retract poppet valve 358 in the counterbalance retract hydraulic circuit 352 to provide a flow path around the counterbalance retract poppet valve 358 to accommodate hydraulic pressure spikes that occur when the actuator 50 is locked by the counterbalance hydraulic circuit 124. Hydraulic fluid flow through the retract bypass hydraulic line 368 is controlled by a retract relief poppet valve 370 disposed in the retract bypass hydraulic line 368. A retract relief pilot line 372 having one end connected to a pilot input 374 of the retract relief poppet valve 370 and an opposite end connected to the retract bypass hydraulic line 368 between the retract relief poppet valve 370 and rod end port 72 controls the retract relief poppet valve 370. The normally closed retract relief poppet valve 370 opens when the pressure at the retract input port 172 is greater than the pressure in the retract relief pilot line 372 to relieve pressure spikes upstream of the counterbalance hydraulic circuit 124.

A regeneration hydraulic circuit 400 supplies hydraulic fluid exhausted from rod end port 72 to the blind end port 70 in order to reduce the volume of high pressure hydraulic fluid that must be supplied by the pumps 100*a*–100*d* to extend the dipper handle 32 at a desired crowd speed. The regeneration hydraulic circuit 400 includes a regeneration hydraulic line 402 that fluidly connects the counterbalance extend hydraulic line 306 to the counterbalance retract hydraulic line 356.

A regeneration pilot operated poppet valve 404 disposed in the regeneration hydraulic line 402 controls the flow of hydraulic fluid through the regeneration hydraulic line 402. The regeneration pilot operated poppet valve 404 is controlled by a regeneration pilot line 406 fluidly connecting the regeneration hydraulic line 402 with a pilot line input port 408 of the regeneration pilot operated poppet valve 404. A regeneration spool valve 410 disposed in the regeneration pilot line 406 selectively fluidly connects the regeneration hydraulic line 402 with the pilot line input port 408 of the regeneration pilot operated poppet valve 404 to control the operation of the regeneration poppet valve 404.

The regeneration spool valve 410 is preferably a two position solenoid valve which controls the flow of hydraulic fluid through the regeneration pilot line 406 by moving between two positions in response to inputs from the operator. In a first position, the regeneration spool valve 410 fluidly connects the pilot line input port 408 of the regeneration poppet valve 404 to the regeneration hydraulic line 402, such that the pressure in the regeneration hydraulic line 402 maintains the regeneration poppet valve 404 in the open position when hydraulic fluid exhausts from the rod end port 72 of the actuator 50. In a second position, the regeneration spool valve 410 fluidly disconnects the pilot line input port 408 of the regeneration poppet valve 404 from the regeneration hydraulic line 402, such that there is insufficient pressure at the pilot line input port 408 of the regeneration poppet valve 404 to maintain regeneration poppet valve 404 in the open position.

Figure 6:
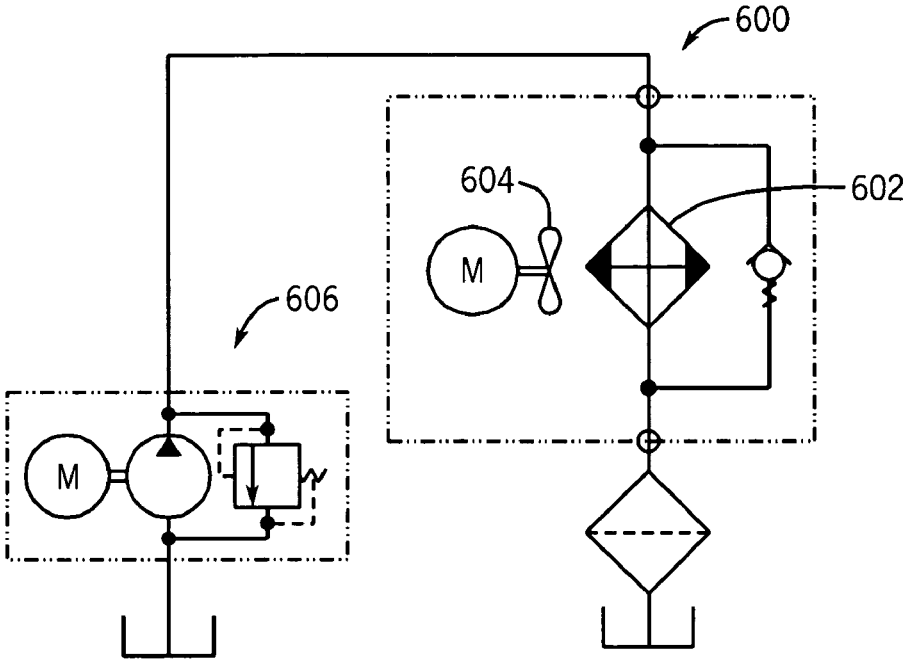
FIG. 6 is a schematic diagram of a cooling hydraulic circuit.

Preferably, the hydraulic fluid in the hydraulic power unit 20 is cooled by pumping the hydraulic fluid through a cooling hydraulic circuit 600, such as shown in FIG. 6. The cooling hydraulic circuit 600 includes a heat exchanger 602 that cools the hydraulic fluid. A fan 604 can be provided that forces air past the heat exchanger 602. The cooling hydraulic circuit 600 can be a stand alone circuit with an independent pump 606, or integrated into hydraulic circuit 106, without departing from the scope of the invention.

In use, with reference to FIGS. 1–5, the dipper handle 32 is extended by the operator providing an input, such as through a joystick, lever, and the like, to the electrical control system. The electrical control system shifts the spool in the proportional control extend spool valve 126 controlling the extend poppet valve 116 disposed in between the input and output extend hydraulic lines 108, 118 of the extend hydraulic circuit 104 from the normally closed position to the open position, such that the pilot input 130 of the extend poppet valve 116 senses the hydraulic fluid pressures in the extend output hydraulic line 118 which allows the extend poppet valve 116 to open. At the same time, the spools in the work port relief spool control valves 202, 252 controlling the work port relief poppet valves 190, 192 are shifted, such that the work port relief pilot line input 200, 250 of each work port relief poppet valve 190, 192 is in fluid communication with the hydraulic supply line 102. Under normal conditions, when the work port relief pilot line inputs 200, 250 sense the pressure in the hydraulic supply line 102, the work port relief poppet valves 190, 192 close to prevent hydraulic fluid from flowing through the short circuit hydraulic line 194. In addition, the electrical control system shifts the spool of the regeneration spool valve 410, such that the hydraulic regeneration poppet valve 404 opens to allow hydraulic fluid to flow through the regeneration hydraulic line 402 from the retraction chamber 68 to the extension chamber 66 of the cylinder 52.

With the extend poppet valve 116 open and the work port relief poppet valve 190 and the retract poppet valve 166 in the closed position, hydraulic fluid in the supply line 102 flows through the input extend hydraulic line 108, the extend poppet valve 116, the output extend hydraulic line 118, the extend input port 122, the counterbalance extend hydraulic line 306, the counterbalance extend poppet valve 308, and into the blind eye port 70 of the cylinder 52 to fill the extension chamber 66 in the cylinder 52 and urge the ram 54 toward the extended position. Hydraulic fluid being forced out of the retraction chamber 68 by the moving ram 54 flows out of the rod end port 72 of the cylinder 52 through the counterbalance retract hydraulic line 356, past the counterbalance retract poppet valve 358, and into the counterbalance extend hydraulic line 306, which ultimately leads back into the extension chamber 66 of the cylinder 52.

If the dipper handle 32 encounters an obstruction as it is being extended, the pressure of the hydraulic fluid rises in the extend hydraulic circuit 104 rises and the pressure of the hydraulic fluid in the retract hydraulic circuit 154 drops. The counterbalance hydraulic circuit 124 attempts to balance the flow of hydraulic fluid exhausting the retraction chamber 68 and entering the extension chamber 66 by adjusting the flow of hydraulic fluid through the counterbalance poppet valves 308, 358 in response to the pressures in the counterbalance extend and retract hydraulic lines 306, 356. If the pressure in the extend hydraulic circuit 104 reaches a predetermined level, however, and the flow of hydraulic fluid cannot be balanced, or is stopped because the obstruction does not allow movement of the dipper handle 32, the increased pressure in the counterbalance extend bypass line 306 causes the extend relief poppet valve 320 to close. Likewise, the increased pressure in the extend hydraulic circuit 104 causes the extend poppet valve 116 to close while the extend and retract work relief poppet valves 190, 240 open to relieve pressure in the extend hydraulic circuit 104 by allowing hydraulic fluid to flow through the short circuit hydraulic line 194. If the pressure continues to increase, once the hydraulic fluid pressure reaches a higher predetermined level, the hydraulic fluid exhausts through relief check valves 500, 502, 506 that allows hydraulic fluid to exit the extend hydraulic circuit 104 and reduce the hydraulic fluid pressure therein.

If a hydraulic line breaks in the extend hydraulic circuit 104 between the extend poppet valve 116 and the blind end port 70 as the dipper handle 32 is extending which results in a sudden drop in pressure in the extend hydraulic circuit 104, the extend poppet valve 116 immediately closes to prevent the pumps 100*a*–100*d* from continuously pumping hydraulic fluid through the break. Likewise, the counterbalance retract poppet valve 358 and counterbalance retract relief poppet valve 370 close to stop the flow of hydraulic fluid exhausting from the retraction chamber 68.

The dipper handle 32 is retracted by the operator providing an input, such as through a joystick, lever, and the like, to the electrical control system. The electrical control system shifts the spool in the proportional control retract spool valve 176 controlling the retract poppet valve 166 disposed in between the input and output retract hydraulic lines 158, 168 of the retract hydraulic circuit 154 from the normally closed position to the open position, such that the pilot input 180 of the retract poppet valve 166 senses the hydraulic fluid pressures in the retract output hydraulic line 168 which allows the retract poppet valve 166 to open. At the same time, the spools in the work port relief spool control valves 202, 252 controlling the work port relief poppet valves 190, 192 are shifted, such that the work port relief pilot line input 200, 250 of each work port relief poppet valve 190, 192 is in fluid communication with the hydraulic supply line 102. Under normal conditions, when the work port relief pilot line inputs 200, 250 sense the pressure in the hydraulic supply line 102, the work port relief poppet valves 190, 192 close to prevent hydraulic fluid from flowing through the short circuit hydraulic line 194. In addition, the electrical control system shifts the spool of the regeneration spool valve 410, such that hydraulic the regeneration poppet valve 404 closes to prevent hydraulic fluid from flowing through the regeneration hydraulic line 402 from the retraction chamber 68 to the extension chamber 66 of the cylinder 52.

If the dipper handle 32 encounters an obstruction as it is being retracted, the pressure of the hydraulic fluid rises in the retract hydraulic circuit 154 and the pressure of the hydraulic fluid in the extend hydraulic circuit 104 drops. The counterbalance hydraulic circuit 174 attempts to balance the flow of hydraulic fluid exhausting the extension chamber 66 and entering the retraction chamber 68 by adjusting the flow of hydraulic fluid through the counterbalance poppet valves 308, 358 in response to the pressures in the counterbalance extend and retract hydraulic lines 306, 356.

Preferably, the position of the dipper handle 32 is determined by a position feedback system, such as a laser distance measurometer, string potentiometer, shaft encoder, and the like, electrically connected to the electrical control system. Signals provided by the position feedback system are processed by the electrical control system to determine the position of the dipper handle. Advantageously, once the position of the dipper handle 32 is known, the handle can be automatically controlled to provide smooth stops when reaching the extended and retracted positions to avoid shocks resulting from a hard stop.

Figure 7:
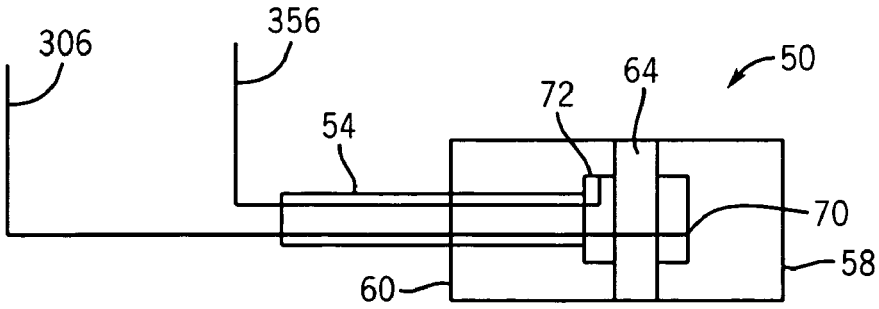
FIG. 7 is an alternative embodiment of a hydraulic actuator.

In an alternative embodiment shown in FIG. 7, the actuator 50 includes a blind end port 70 in fluid communication with the counterbalance extend hydraulic line 306 through the ram 54, and a rod end port 72 in fluid communication with the counterbalance retract hydraulic line 356 through the ram 54. This embodiment is preferred when the ram is fixed relative to the hydraulic lines 306, 356 and the cylinder 52 moves relative to the ram 54.

While there has been shown and described what is at present considered the preferred embodiment of the invention, it will be obvious to those skilled in the art that various changes and modifications can be made therein without departing from the scope of the invention defined by the appended claims.

The invention claimed is:

1. A crowd control mechanism comprising:

an extendible dipper handle supported by a saddle block and having an extended position and a retracted position, said dipper handle being slidable relative to said saddle block between said extended and retracted positions;

a double acting hydraulic cylinder having an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid;

a first pilot operated poppet valve disposed in said first hydraulic line, and controlling the flow of hydraulic fluid through said first hydraulic line into said blind end port;

a second pilot operated poppet valve disposed in said second hydraulic line, and controlling the flow of hydraulic fluid through said second hydraulic line into said rod end port;

a first counter balance cartridge having an input pilot line in fluid communication with said second hydraulic line to sense a hydraulic fluid pressure in said second hydraulic line, and an output pilot line in fluid communication with said first pilot operated poppet valve to control said first pilot operated poppet valve in the event of said hydraulic fluid pressure in said second hydraulic line exceeding a hydraulic fluid pressure in said first hydraulic fluid line when said dipper handle is being urged toward said extended position; and a second counter balance cartridge having an input pilot line in fluid communication with said first hydraulic line to sense a hydraulic fluid pressure in said first hydraulic line, and an output pilot line in fluid communication with said second pilot operated poppet valve to control said second pilot operated poppet valve in the event of said hydraulic fluid pressure in said first hydraulic line exceeding said hydraulic fluid pressure in said second hydraulic fluid line when said dipper handle is being urged toward said retracted position.

2. A crowd control mechanism comprising:

a dipper handle having an extended position and a retracted position:

a double acting hydraulic cylinder having an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid;

a first pilot operated poppet valve disposed in said first hydraulic line, and controlling the flow of hydraulic fluid through said first hydraulic line into said blind end port;

a second pilot operated poppet valve disposed in said second hydraulic line, and controlling the flow of hydraulic fluid through said second hydraulic line into said rod end port;

a first counter balance cartridge having an input pilot line in fluid communication with said second hydraulic line to sense a hydraulic fluid pressure in said second hydraulic line, and an output pilot line in fluid communication with said first pilot operated poppet valve to control said first pilot operated poppet valve in the event of said hydraulic fluid pressure in said second hydraulic line exceeding a hydraulic fluid pressure in said first hydraulic fluid line when said dipper handle is being urged toward said extended position; and a second counter balance cartridge having an input pilot line in fluid communication with said first hydraulic line to sense a hydraulic fluid pressure in said first hydraulic line, and an output pilot line in fluid communication with said second pilot operated poppet valve to control said second pilot operated poppet valve in the event of said hydraulic fluid pressure in said first hydraulic line exceeding said hydraulic fluid pressure in said second hydraulic fluid line when said dipper handle is being urged toward said retracted position;

wherein a first hydraulic bypass line bypasses said first pilot operated poppet valve, and a third pilot operated poppet valve disposed in said first hydraulic bypass line controls the flow of hydraulic fluid through said first hydraulic line into said blind end port, and a second hydraulic bypass line bypasses said second pilot operated poppet valve, and a fourth pilot operated poppet valve disposed in said second hydraulic bypass line controls the flow of hydraulic fluid through said second hydraulic line into said rod end port.

3. The crowd control mechanism as in claim 1, in which a first proportional poppet valve disposed in the first hydraulic line controls the flow of hydraulic fluid through said first hydraulic line into said blind end port, a first proportional control valve disposed in a first pilot line in fluid communication with said first hydraulic line and said first proportional poppet valve proportional valve controls the flow of hydraulic fluid through said first proportional poppet valve, wherein said first proportional control valve is operatively controlled by a user.

4. A crowd control mechanism comprising:

a dipper handle having an extended position and a retracted position;

a double acting hydraulic cylinder having an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid;

a first pilot operated poppet valve disposed in said first hydraulic line, and controlling the flow of hydraulic fluid through said first hydraulic line into said blind end port;

a second pilot operated poppet valve disposed in said second hydraulic line, and controlling the flow of hydraulic fluid through said second hydraulic line into said rod end port;

a first counter balance cartridge having an input pilot line in fluid communication with said second hydraulic line to sense a hydraulic fluid pressure in said second hydraulic line, and an output pilot line in fluid communication with said first pilot operated poppet valve to control said first pilot operated poppet valve in the event of said hydraulic fluid pressure in said second hydraulic line exceeding a hydraulic fluid pressure in said first hydraulic fluid line when said dipper handle is being urged toward said extended position: and a second counter balance cartridge having an input pilot line in fluid communication with said first hydraulic line to sense a hydraulic fluid pressure in said first hydraulic line, and an output pilot line in fluid communication with said second pilot operated poppet valve to control said second pilot operated poppet valve in the event of said hydraulic fluid pressure in said first hydraulic line exceeding said hydraulic fluid pressure in said second hydraulic fluid line when said dipper handle is being urged toward said retracted position:

wherein a regeneration hydraulic fluid line connects said first and second hydraulic lines, and a regeneration poppet valve disposed in said regeneration hydraulic fluid line controls the flow of hydraulic fluid through said regeneration hydraulic fluid line.

5. The crowd control mechanism as in claim 4, in which a regeneration poppet valve pilot line connects said regeneration poppet valve and said source of pressurized hydraulic fluid, and a solenoid control valve disposed in said regeneration poppet valve pilot line controls the flow of hydraulic fluid in said regeneration poppet valve pilot line to control said regeneration poppet valve.

6. The crowd control mechanism as in claim 1, in which a supply line supplies pressurized hydraulic fluid to said first and second hydraulic lines.

7. The crowd control mechanism as in claim 6, in which as least one hydraulic pump supplies pressurized hydraulic fluid to said supply line.

8. The crowd control mechanism as in claim 1, in which hydraulic fluid flowing into said cylinder through one of said blind eye port and said rod end port flows at a rate of at least 100 gpm.

9. The crowd control mechanism as in claim 1, in which hydraulic fluid flowing into said cylinder through one of said blind eye port and said rod end port flows at a rate of at least 300 gpm.

10. A crowd control mechanism comprising:

an extendible dipper handle supported by a saddle block and having an extended position and a retracted position, said dipper handle being slidable relative to said saddle block between said extended and retracted positions;

a double acting hydraulic cylinder having a an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid; a first proportional pilot operated poppet valve disposed in the first hydraulic line controls the flow of hydraulic fluid through said first hydraulic line into said blind end port;

a first pilot line having one end connected to said first proportional pilot operated poppet valve and an opposing end in fluid communication with said first hydraulic line downstream of said first proportional pilot operated poppet valve;

a first proportional control spool valve disposed in said first pilot line, wherein said first proportional control spool valve controls the flow of hydraulic fluid through said first pilot line to control said first proportional pilot operated poppet valve;

a second proportional pilot operated poppet valve disposed in the second hydraulic line controls the flow of hydraulic fluid through said second hydraulic line into said rod end port;

a second pilot line having one end connected to said second proportional pilot operated poppet valve and an opposing end in fluid communication with said second hydraulic line downstream of said second proportional pilot operated poppet valve; and a second proportional control spool valve disposed in said second pilot line, wherein said second proportional poppet valve controls the flow of hydraulic fluid through said second pilot line to control said second proportional pilot operated poppet valve.

11. A crowd control mechanism comprising:

a dipper handle having an extended position and a retracted position;

a double acting hydraulic cylinder having a an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid;

a first proportional pilot operated poppet valve disposed in the first hydraulic line controls the flow of hydraulic fluid through said first hydraulic line into said blind end port;

a first pilot line having one end connected to said first proportional pilot operated poppet valve and an opposing end in fluid communication with said first hydraulic line downstream of said first proportional pilot operated poppet valve;

a first proportional control spool valve disposed in said first pilot line, wherein said first proportional control spool valve controls the flow of hydraulic fluid through said first pilot line to control said first proportional pilot operated poppet valve;

a second proportional pilot operated poppet valve disposed in the second hydraulic line controls the flow of hydraulic fluid through said second hydraulic line into said rod end port;

a second pilot line having one end connected to said second proportional pilot operated poppet valve and an opposing end in fluid communication with said second hydraulic line downstream of said second proportional pilot operated poppet valve; and a second proportional control spool valve disposed in said second pilot line, wherein said second proportional poppet valve controls the flow of hydraulic fluid through said second pilot line to control said second proportional pilot operated poppet valve;

wherein a first hydraulic bypass line bypasses said first pilot operated poppet valve, and a third pilot operated poppet valve disposed in said first hydraulic bypass line controls the flow of hydraulic fluid through said first hydraulic line into said blind end port, and a second hydraulic bypass line bypasses said second pilot operated poppet valve, and a fourth pilot operated poppet valve disposed in said second hydraulic bypass line controls the flow of hydraulic fluid through said second hydraulic line into said rod end port.

12. The crowd control mechanism as in claim 10, including, a third pilot operated poppet valve disposed in said first hydraulic line, and controlling the flow of hydraulic fluid through said first hydraulic line into said blind end port, a fourth pilot operated poppet valve disposed in said second hydraulic line, and controlling the flow of hydraulic fluid through said second hydraulic line into said rod end port;

a first counter balance cartridge having an input pilot line in fluid communication with said second hydraulic line to sense a hydraulic fluid pressure in said second hydraulic line, and an output pilot line in fluid communication with said third pilot operated poppet valve to control said third pilot operated poppet valve in the event of said hydraulic fluid pressure in said second hydraulic line exceeding a hydraulic fluid pressure in said first hydraulic fluid line when said dipper handle is being urged toward said extended position, and a second counter balance cartridge having an input pilot line in fluid communication with said first hydraulic line to sense a hydraulic fluid pressure in said first hydraulic line, and an output pilot line in fluid communication with said fourth pilot operated poppet valve to control said fourth pilot operated poppet valve in the event of said hydraulic fluid pressure in said first hydraulic line exceeding said hydraulic fluid pressure in said second hydraulic fluid line when said dipper handle is being urged toward said retracted position.

13. A crowd control mechanism comprising:

a dipper handle having an extended position and a retracted position;

a double acting hydraulic cylinder having a an extendible ram, wherein one of said cylinder and said ram is fixed to said dipper handle and the other of said cylinder and said ram is stationary relative to said dipper handle, at least one of said cylinder and said ram having at least one of a blind end port and a rod end port, and at least one of said cylinder and said ram having the other of said blind end port and said rod end port, wherein hydraulic fluid flowing into said cylinder through said blind end port urges said ram toward an extended position to extend said dipper handle, and hydraulic fluid flowing into said rod end port urges said ram toward a retracted position to retract said dipper handle;

a first hydraulic fluid line connected to said blind end port and a source of hydraulic fluid;

a second hydraulic fluid line connected to said rod end port and a source of hydraulic fluid;

a first proportional pilot operated poppet valve disposed in the first hydraulic line controls the flow of hydraulic fluid through said first hydraulic line into said blind end port;

a first pilot line having one end connected to said first proportional pilot operated poppet valve and an opposing end in fluid communication with said first hydraulic line downstream of said first proportional pilot operated poppet valve;

a first proportional control spool valve disposed in said first pilot line, wherein said first proportional control spool valve controls the flow of hydraulic fluid through said first pilot line to control said first proportional pilot operated poppet valve;

a second proportional pilot operated poppet valve disposed in the second hydraulic line controls the flow of hydraulic fluid through said second hydraulic line into said rod end port;

a second pilot line having one end connected to said second proportional pilot operated poppet valve and an opposing end in fluid communication with said second hydraulic line downstream of said second proportional pilot operated poppet valve; and a second proportional control spool valve disposed in said second pilot line, wherein said second proportional poppet valve controls the flow of hydraulic fluid through said second pilot line to control said second proportional pilot operated poppet valve;

wherein a regeneration hydraulic fluid line connects said first and second hydraulic lines, and a regeneration poppet valve disposed in said regeneration hydraulic fluid line controls the flow of hydraulic fluid through said regeneration hydraulic fluid line.

14. The crowd control mechanism as in claim 13, in which a regeneration poppet valve pilot line connects said regeneration poppet valve and said source of pressurized hydraulic fluid, and a solenoid control valve disposed in said regeneration poppet valve pilot line controls the flow of hydraulic fluid in said regeneration poppet valve pilot line to control said regeneration poppet valve.

15. The crowd control mechanism as in claim 10, in which a supply line supplies pressurized hydraulic fluid to said first and second hydraulic lines.

16. The crowd control mechanism as in claim 15, in which as least one hydraulic pump supplies pressurized hydraulic fluid to said supply line.

17. The crowd control mechanism as in claim 10, in which hydraulic fluid flowing into said cylinder through one of said blind eye port and said rod end port flows at a rate of at least 100 gpm.

18. The crowd control mechanism as in claim 10, in which hydraulic fluid flowing into said cylinder through one of said blind eye port and said rod end port flows at a rate of at least 300 gpm.

* * * * *